United States Patent [19]

Fierro

[11] Patent Number: 5,064,977

[45] Date of Patent: Nov. 12, 1991

[54] MOLDED UNITARY FRAME FOR CIRCUIT PROTECTION

[75] Inventor: Joseph Fierro, Trenton, N.J.

[73] Assignee: Heinemann Electric Company, Lawrenceville, N.J.

[21] Appl. No.: 428,067

[22] Filed: Oct. 26, 1989

Related U.S. Application Data

[63] Continuation-in-part of Ser. No. 337,578, Apr. 13, 1989, Pat. No. 4,931,762.

[51] Int. Cl.[5] ..... H01H 33/08

[52] U.S. Cl. ..... 200/293; 200/306; 200/304; 200/401

[58] Field of Search ..... 200/293, 303, 304, 305, 200/306, 339, 401

[56] References Cited

U.S. PATENT DOCUMENTS

| | | | |
|---|---|---|---|
| 3,211,860 | 10/1965 | Stephenson, Jr. et al. | 200/293 X |
| 3,341,791 | 9/1967 | Leonard | 200/304 X |
| 4,075,446 | 2/1978 | Aadahl | 200/306 X |
| 4,757,294 | 7/1988 | Todaro et al. | 200/293 X |

*Primary Examiner*—Ernest G. Cusick

*Attorney, Agent, or Firm*—Dann, Dorfman, Herrell and Skillman

[57] ABSTRACT

A circuit protector employs molded resinous parts including a base and a support frame structure. Advantageously the circuit protector support frame structure may include a medial plane frame providing space for two circuit protectors, one on each side of the frame and a common back plane mutually perpendicular to the medial frame and the base along one edge of the base. A cover fits over the support frame and base and snugly accommodates the base at its terminal edges except immediately along the back plane. The back plane is provided with a slot through the back plane in the vicinity of each pair of contacts which communicates to a space between the cover and the back plane of the base permitting venting of gases generated by arcing. Grooves are supplied in the medial plane frame and the back plane to accommodate edge flanges of an arc suppressing grid to hold the grid in place to bracket the contacts.

4 Claims, 8 Drawing Sheets

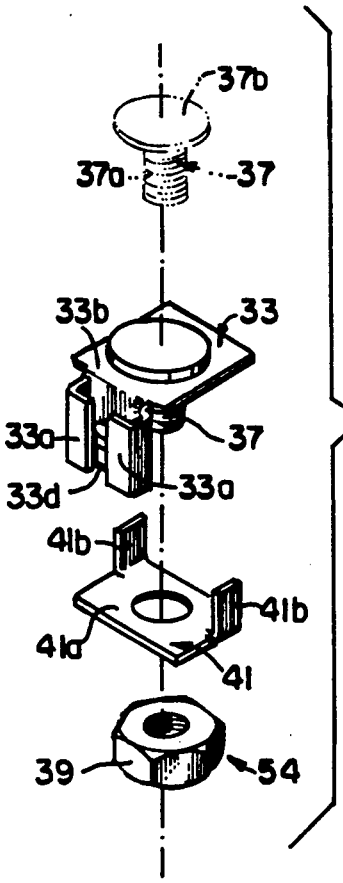
FIG. 2A
FIG. 2B
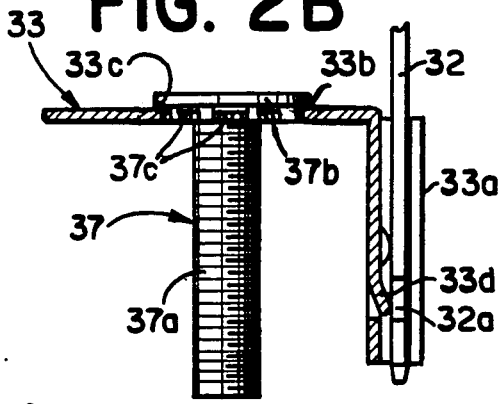
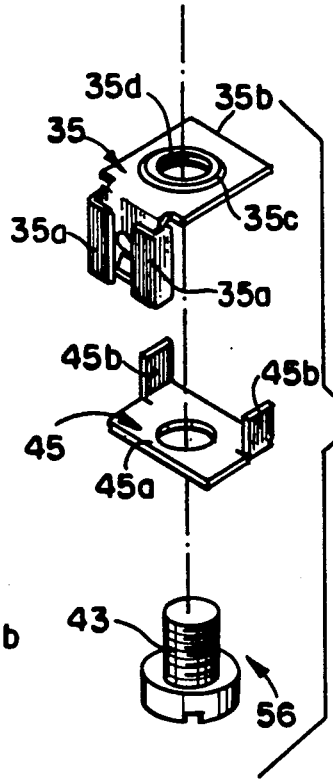
FIG. 2C
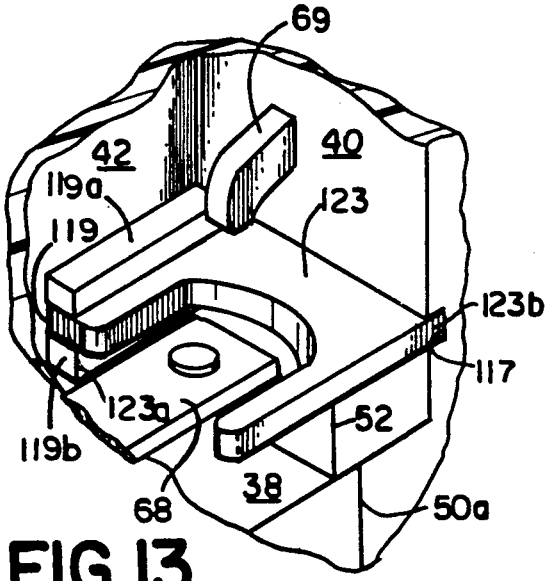
FIG. 13

MOLDED UNITARY FRAME FOR CIRCUIT PROTECTION

This is a continuation-in-part of U.S. application Ser. No. 337,578 filed Apr. 13, 1989, now U.S. Pat. No. 4,931,762.

The present invention relates to a circuit protector construction and more particularly to a circuit protector having a unique base and mounting frame and a few simple easily assembled mechanical parts, some of which may serve for both poles of a two pole circuit protector.

BACKGROUND OF THE INVENTION

In the prior art circuit protectors of the general type of the present invention have been broadly disclosed in United States patents such as U.S. Pat. Nos. 4,167,720 and 4,258,349. These structures characteristically employ a rocker handle which is rotatably supported to a frame by a pin and provides a linkage crank which, in turn, is connected by a linkage to a switch actuating rocker. The linkage is connected to the linkage crank and rocker by rotatable pin connections parallel to the handle supporting pin. Characteristically the rocker which has a parallel pin trapped in a guide slot is engaged by a pivoted latch member also with a pin parallel to the others, which holds the latched end of the rocker in position as the rocker is moved by the handle member through the linkages against the movable contact arm to close the circuit protector contacts. The handle may be able to open the circuit protector contacts by rotation back the opposite direction. Upon overload, the contacts are opened as the latch member is moved releasing the latched end of the rocker to reposition so that the contacts will be able to open.

The applicant's assignee Heinemann Electric Company has manufactured thermally actuated circuit protectors using a rocker handle. Such a circuit protector has had a somewhat different configuration shown in U.S. Pat. Nos. 4,338,586 and 4,436,972.

THE ADVANCE IN THE ART

The present invention provides a circuit protector actuator construction employing much structural resemblance to the prior art but in which important improvements over the prior art are introduced. A geometry which is quite simple lends itself to construction of many of the mechanical parts from molded resinous material, such as, for example, General Electric Company's ULTEM ®. In particular the base preferably supports preassembled contact and external terminal assemblies which are easily assembled to the base by sliding them into preformed grooves in a base plate which preferably is of rigid molded resinous material. Slip-on adapters permit easy conversion of a conventional spade terminal to a screw type terminal. The device is particularly well suited to use a thermal actuator for tripping the switch of this circuit breaker, or circuit interrupter. A bi-metallic member preassembled, calibrated and stored as inventory before assembly into the base, may still be adjusted thereafter, even after assembly has been completed, and even after the cover has been put into place.

A novel arrangement for wiring and support of a lamp remote from a switch, which, for example, when actuated by the movable contact support arm, may by the illumination of the lamp show that the contacts are closed. Other switch arrangements may produce illumination under other conditions. Various types of bulbs may be employed. However, the arrangement permits a novel bulb support provided by the medial plane frame using wiring in alternating interconnected channels in the two sides of the medial plane frame.

The same medial plane frame enables a symmetrical actuator structure on both sides of the medial plane for a two pole configuration. Parallel crank arms of the handle are connected to parallel arms of the rocker on opposite sides of the medial plane preferably using novel integral pin linkages which provide rotatable pins parallel to the axis of the rotatable pin supporting the handle. These pins are sized and configured to snap into prepared holes in the handle linkage crank and the rocker. The rocker itself is not directly pinned to the frame, but preferably uses has a single molded resinous pin extending between its parallel arms on opposite sides of the medial plane. The pin which may be inserted into a subassembly positioned on the frame by the handle pin positions the parallel rocker pin to ride in a guide slot in the medial plane frame in order to limit the movement of the rocker. When the circuit protector is tripped because overload occurs in a single pole, the latch lever is moved out of position to retain the latch surface of the rocker and both poles are opened. The rocker, which is normally engaged and positioned by the latch keeper, moves to upset the over-center equilibrium achieved when the link pin to the handle link moves between the other link pin to the rocker and the handle pin. The force of a spring between frame and handle is now sufficient to restore the off position of the handle because of movement of the intermediate link pin over center between the handle pin and the rocker link pin. The camming surface on the rocker actuating the switch arm into the closed contact position is released in the process. The stability of the linkage is disturbed and the handle spring returns the handle to off position, assuring that the contacts remain open.

A back plane attached to the medial plane is spaced from the casing and supplied with a vent slot to afford controlled venting of gases generated, for example, by arcing of the contacts. The vent passage is continued by providing spacing between the back plane and the housing. The medial plane frame and the back plane also provide slots to carry a gradient plate to aid in suppressing arcs at the contacts.

The latch lever itself has a unique structure and orientation in the present invention. It is pivotally supported on a pin parallel to the other pins. A spring between the frame and the latch lever holds the latch keeper in engagement with the transversely oriented rocker except for the times when thermal overload occurs moving the latch lever against the bias of the spring and releasing the rocker. Latching can be restored when off position of the switch handle is achieved since the handle spring through the linkage moves the rocker back into position to be latched. A cam surface is provided on either latch lever or rocker to move the latch lever out of the way of rocker movement against its light spring bias. Once past the latch keeper, the latch bias holds the rocker and latch lever in contact until the handle is again moved to close the contacts of both poles.

More broadly, the present invention relates to a circuit protector construction employing a support base having a support frame arranged generally transverse thereto. At least a pair of terminals are supported on the base. One of the pair of terminals is connected directly to a circuit protector switch contact and the other is connected through an overload actuator element to a second movable contact on a movable arm. A circuit protector actuating handle is rotatably supported on the frame by a pin and provides a linkage crank arm. A handle spring between the handle and the frame urges the handle into its open contact position. A link is connected to the linkage crank arm of the handle by a rotatable pin connection and connected to the rocker by a parallel pin whereby movement of the handle will cause movement of a switch actuator portion of the rocker in contact with a latch lever to close the circuit protector switch contacts when the latch is engaged. The rocker pin parallel to the handle pin is guided by a slot in the frame. The latch lever is pivotably supported on the frame by a pin parallel to the aforesaid pins and provides a latch keeper to engage and hold the rocker. The latch spring extends between the latch lever and the frame to urge the latch lever into engagement with a latch surface of the rocker. When the handle rotates to close the contacts of the circuit protector, it moves the linkage pivot point to the linkage arm over center between the handle pin and other linkage pin to stably hold the switch in closed contact condition. Release of the latch lever by overload forces releases the rocker latch surface from the latch keeper and allows movement of the rocker to an unstable position such that the handle spring moves the lever arm pin back over center to allow the rocker switch actuator to free the movable contact.

DRAWINGS OF A PREFERRED EMBODIMENT

FIG. 2A is an exploded perspective view of a screw type adapter for application to a spade terminal;

FIG. 2B is an enlarged partially sectioned view of a piece of the assembly of FIG. 2A;

FIG. 2C is an exploded perspective view similar to FIG. 2A of an alternative type of screw adapter.

FIG. 13 is a partial perspective view showing an arc suppressing grid plate inserted into a corner of the support frame.

DESCRIPTION OF A PREFERRED EMBODIMENT

Figure 1:
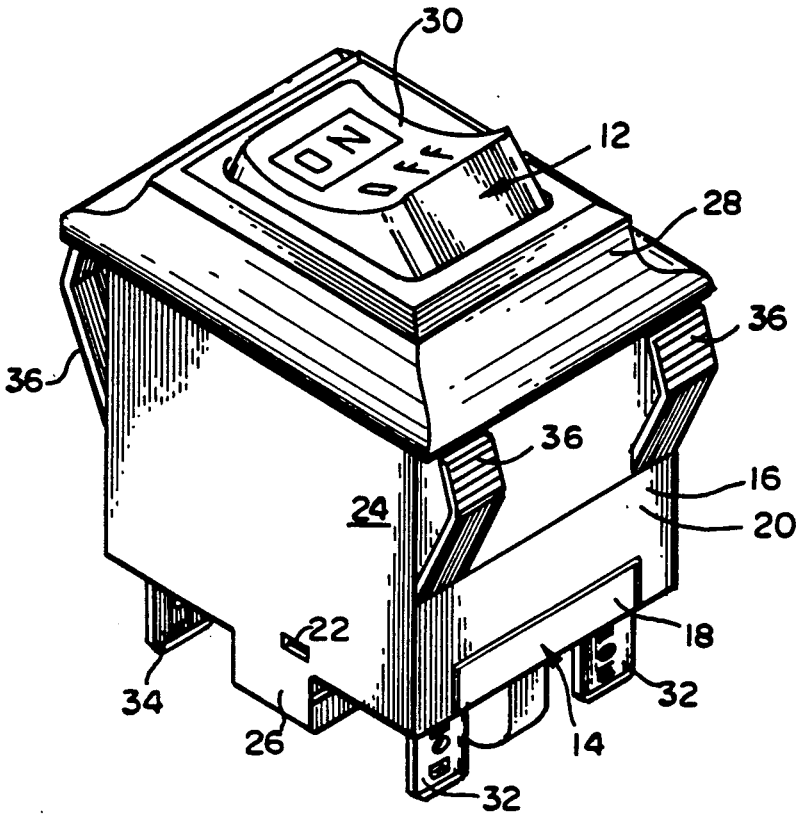
FIG. 1 is a perspective view of the circuit protector of the present invention within its outer casing.

FIG. 1 illustrates a circuit protector of the present invention. This protector is a circuit protector which employs thermally activated actuators to release the closed contacts in the event of overload. It is also a double pole breaker, both of which poles, however, are triggered by overload at either pole, and both of which poles are simultaneously actuated and closed or opened by a common rocker switch actuator, generally designated 12. The active circuit protector structure is supported on a base, generally designated 14, which also supports the cover 16 which preferably provides a snug fit with the base along the four enclosing lateral walls. The housing or cover for the breaker, like the internal parts, may be made of a moldable resinous material such as, for example, General Electric Company's VALOX SEO materials. The cover may be indexed by the rectangular protrusion 18 which fits snugly within a matching cutout at the bottom of the cover sidewall 20 with which it cooperates. Detents on the base may be provided to engage holes 22 in sidewall 24 and the walls other than 20. Wall 24 and its opposite wall may be provided with extension tabs 26 which cover the ends of channels in the base 14. A bezzle or conforming frame 28 is preferably provided above the cover sidewalls to surround the frame and allows the rocker handle 30 to protrude from a closely conforming opening so that it can easily be actuated and at the same time encloses and protects the rest of the breaker mechanism within. Supported by and extending through the base are a similar set of terminal members 32 and 34 for each circuit protector pole to enable electrical connection to the respective poles.

The bezzle or frame 28 is made considerably larger than the top of the sidewall enclosure of the housing including walls 20 and 24 and their opposite walls. The walls themselves are generally perpendicular to each other and to the bezzle. The bezzle is flat on its bottom, thus providing a shoulder or overhang which may be held against a panel board to support the circuit protector in position on the panel board. Conventionally, panel boards are provided with openings generally the size of the circuit protector housing cover sidewalls 20, 24, etc. in order to allow passage of the sidewalls through the opening but to abut the frame enabling support of the frame against the panel wall in some manner. In this case, a preferred arrangement is to provide collapsible spring fingers 36 at the corner edges of wall 20 and its opposing wall. As seen, these spring fingers are molded integrally with the housing and attached a substantial distance down the sidewall from the frame. These fingers 36 extend upwardly toward the frame and slightly away from their supporting sidewall to a point where they change direction back toward the sidewall as they approach the frame. Sufficient room must be allowed between them and the frame to permit free movement, even when the fingers are flattened against the sidewall as the circuit protector is inserted into an opening of the panel. The outside surface of the ends of the fingers 36 are grooved or roughened. Grooving parallel to the edge of the panel board may aid in retaining a panel board edge as the circuit protector passes through the panel board and the fingers are first resiliently depressed and then spring outwardly toward their original position as far as the panel hole edges permit.

Figure 2:
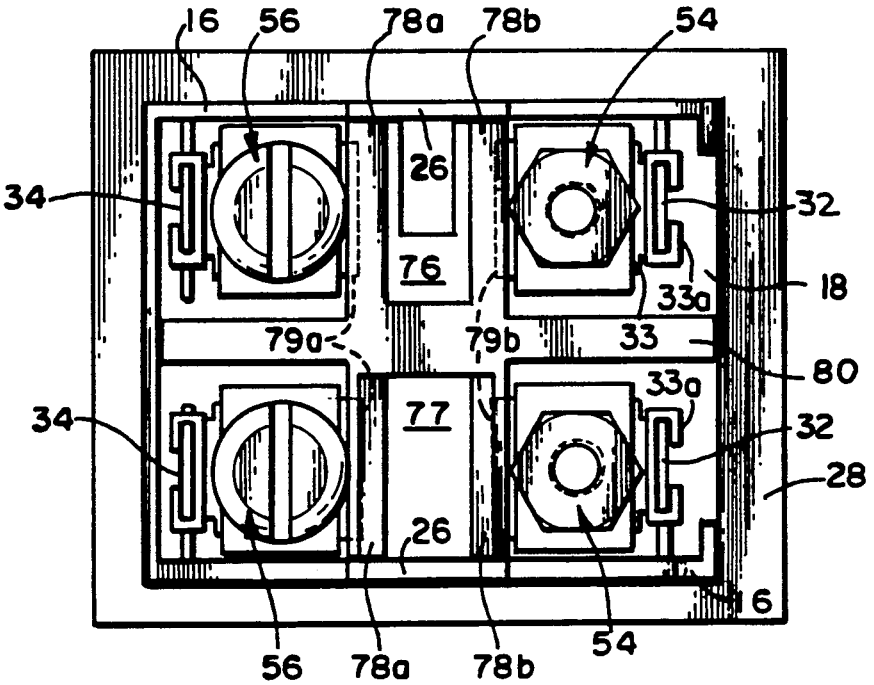
FIG. 2 is a plan view of the bottom of the structure of FIG. 1.
Figure 3:
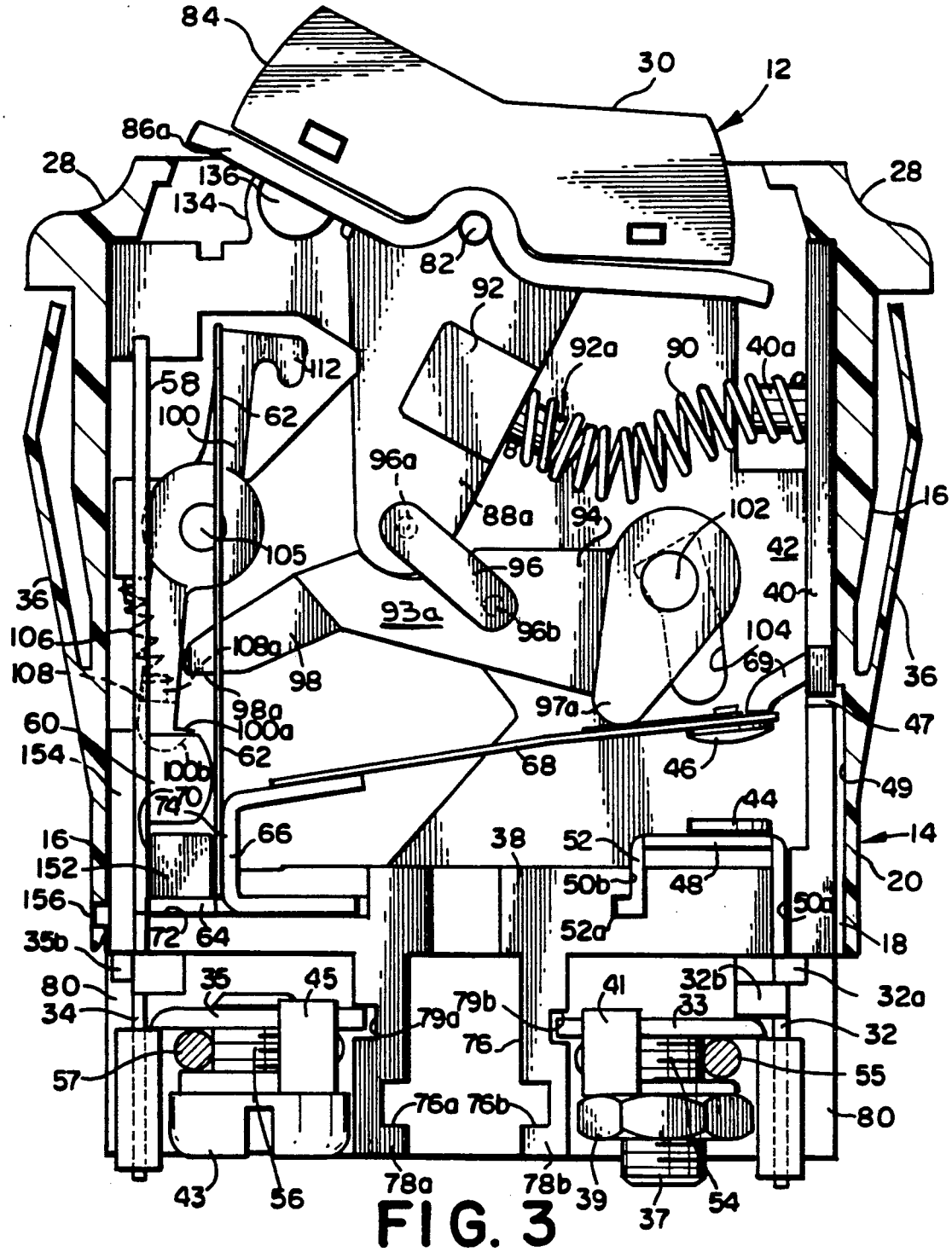
FIG. 3 is a sectional view taken just inside the cover, including a jog at the frame, to provide a side elevational view from one side of the circuit protector with the switch contacts in open position.
Figure 5:
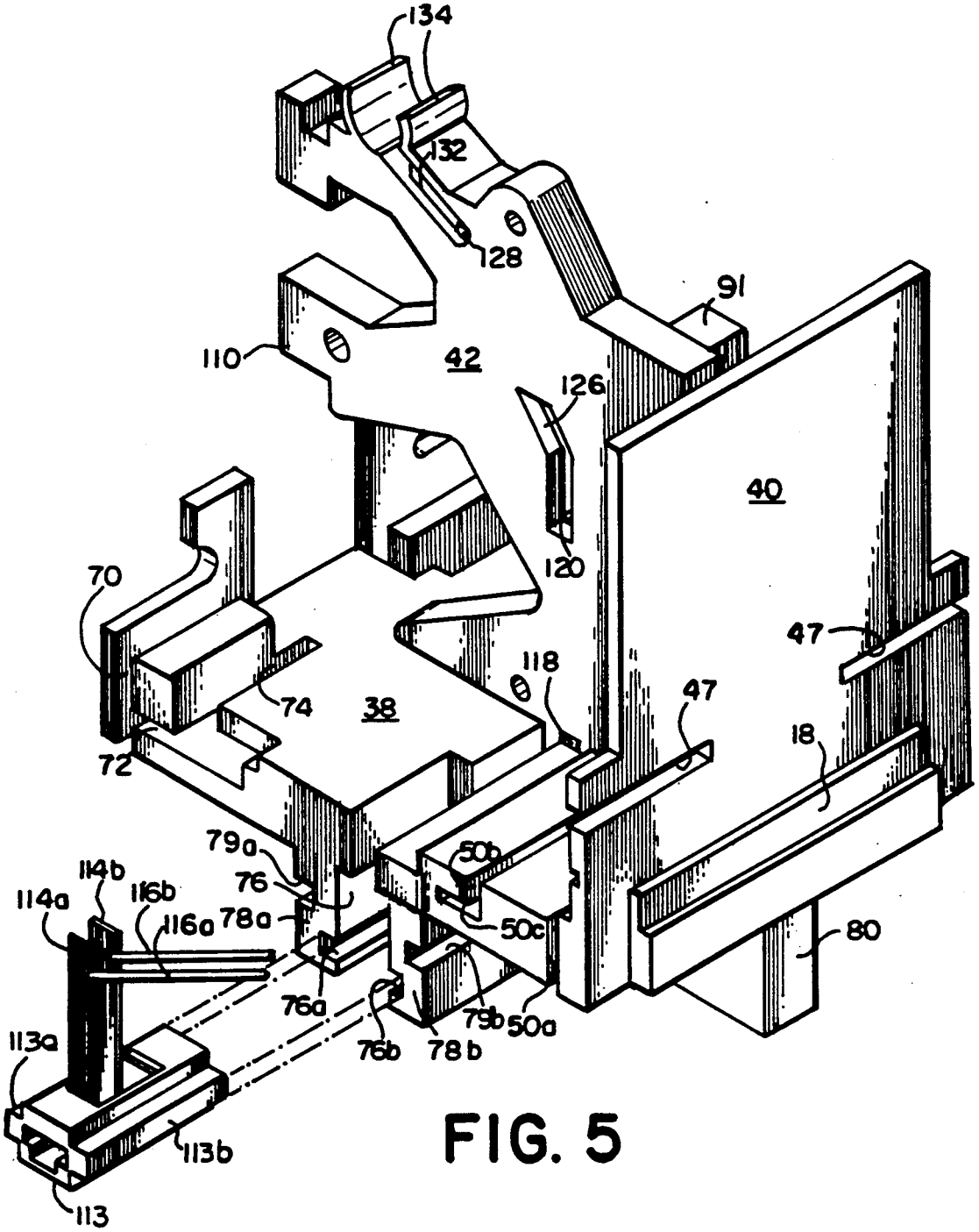
FIG. 5 is a perspective view of the base and support frame of a preferred embodiment of the present invention.
Figure 6:
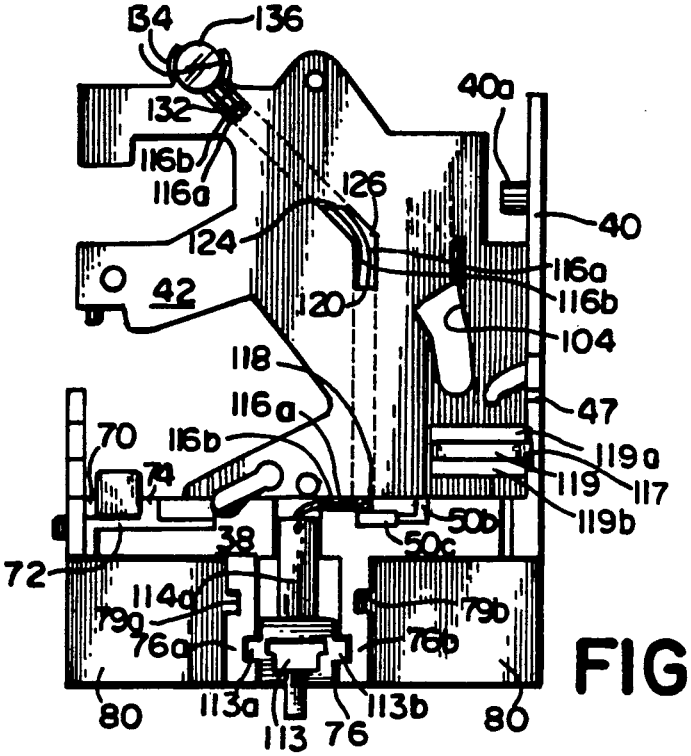
FIG. 6 is a side elevational view of the frame structure of FIG. 5.
Figure 7:
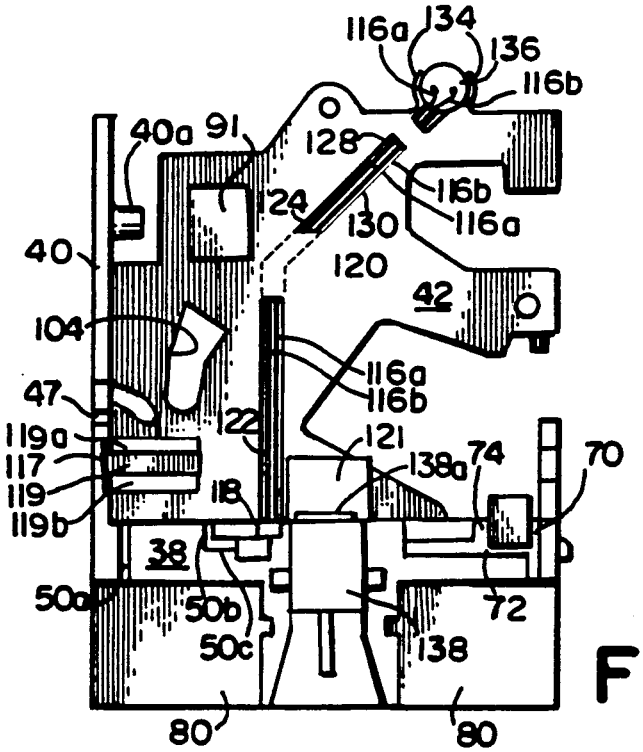
FIG. 7 is a similar elevational view of the frame structure of FIG. 5 from the opposite side.

FIG. 3 is a sectional view parallel to sidewall just inside that wall along the edge of the mounting base. The structure of the base and support frame can be further seen and understood by reference to FIG. 5. FIG. 5 shows the base structure isolated from all other structure in FIG. 3. A plan view of the bottom of the base is shown in FIG. 2. FIGS. 6 and 7 are also views of the base from opposite sides thereof. The base 14, which may be made of ULTEM ®, consists of a rather thick base plate 38 in and through which are provided grooves to support the terminals and circuit protector contact support members. The rectangular protrusion 18 is an extension of the base plate and is also part of a back plane wall 40, generally perpendicular to the base along one edge of the base and extending parallel to the terminal supporting grooves on the base. Perpendicular to the back plane 40 is a medial plane frame 42 which is cut into an irregular shape in order to provide clearance in places where that is necessary or desirable to accommodate movement of parts. The medial plane frame 42 is attached both to the base plate 38 and the back plate 40 and provides support structure for the various parallel pins of the actuator system.

The circuit protector switch contacts are provided by a fixed contact 44 and a movable contact 46. Fixed contact 44 is supported in good electrical contact on a generally U-shaped conductor 48, the terminal leg 32 of which is much longer than the other leg. Bent laterally from the terminal 32, for example, are tines **32*a* and 32*b*, which underlie the base plate 38 and help prevent vertical movement the direction of extension of terminal 32 in passage 50*a* through the base plate 38. A parallel slot 50*b* in the base plate accommodates leg 52. At the termination of shorter leg 52 is a laterally extending tine 52*a* which is accommodated by a small passage 50*c* transverse to the end of passage 50*b*. All of these passages are slots extending from the edge of the base plate as seen in FIG. 5** to permit lateral insertion of the terminal assembly.

Venting of gases that may result from arcs is accomplished in this case by providing a slot 47 in back plane 40 which extends through the back plane into a passage 49 formed between a recessed portion of the breaker housing sidewall 20 and the back plane. As better seen in FIG. 5, member 18 is stepped and its lower relief portion holds the recessed portion of the housing sidewall 20 away from the back plane 20 and slots 47. The higher relief portion acts as a stop to a conforming part of the cover. Thus gas flow comes through the slots and down and out between the bottom edges of base 38 and sidewall 20 around member 18, only the end of which is seen in FIG. 3. A devious restricted path thereby provided effectively meters the outflow from inside the casing of gases which may be generated by arcing for example.

So called "spade terminals", which are planar prong connectors, are shown in FIG. 1. Various types of modified connectors are well known and can be employed with the present invention. In the illustrated embodiment shown in FIGS. 2 and 3 the spade connectors have added to them adapters permitting screw type connections. The adapters, the connector and saddle pieces are novel as is the use of the base enclosure. There are two versions illustrated respectively in FIGS. 2A and 2C as well as FIG. 2 and 3. FIG. 2A shows a stud connector, here generally designated as connector 54, connected to spade terminal 32. The other type shown in FIG. 3C is a screw connector 56 for attachment to spade terminal 34 as seen in FIG. 3.

Referring first to FIGS. 2A and 2B, slip-on support **33*a* slips over a spade terminal 32 and includes a folded sheet metal bracket member arranged to snugly enclose the spade terminal. A lanced spring tab 33*d* will be deflected as support 33*a* is slipper over spade terminal 32 until it reaches and can deflect into hole 32*a* in the terminals to hold members 32 and 33 together. Slip-on support 33*a* is formed integrally with a stud supporting flange 33*b* in a generally L-shaped structure with the supporting flange at right angles to the slip-on support 33*a*. This stud supporting flange 33*b* is provided with a circular opening 33*c*. Under the head 37*b* of the stud element 37 are provided serations 37*c* which are pressed into the edge of the hole 33*c* to secure the stud in place. The stud 37 is in the form of a screw. Pressing the head 37*b* into the opening 33*c* allows slip-on support 33 to support the threaded shank 37*a* with its axis generally parallel to the spade terminal 32. Saddle 41 is a planar surface member with an opening for receiving stud 37*a* parallel and opposed to the planar support 33*b*. Upturned tabs 41*b* at the edges of the surface 41*a* embrace the edges of member 33*b* so that saddle 41 together with the support 33 defines a partial enclosure around stud 37 except along one edge. Finally a nut 39 threaded onto the stud 37 holds the saddle 41** in place.

Both types of assembled structures are seen in FIGS. 2 and 3 with the wire conductors securely in place between the saddle and support. It will be observed from FIG. 2 that all sides but one of the connector are closed and access for inserting the conductor may be had from only one edge which is partially blocked by one of the tabs on saddle 41 or 45. This enclosure tends to guide a conductor into position around a screw. Connectors 54 are also protected by being located in a sort of pocket formed by the base 38, wall 80 and wall **78*b*. Similarly, connectors 56 are protected by base 38, wall 80 and wall 78*a* between the saddle 41 and the support 33*b*** before the connector is screwed together to clamp the conductor in place.

As a practical matter, support pieces **33*b* and 35*b* are supported not only by spade terminals 32 and 34 but by a slot 79*b* or 79*a* in wall 78*b* or 78*a* as seen in FIG. 3. Furthermore, as the adapter piece 33 (or 35) is slid onto the spade terminal 32 (or 34), as seen in FIG. 2B, a lanced spring tab 33*d* is engaged in a hole 32*a* in the spade terminal 32 to hold the structure in place. The spade terminal 32 can flex slightly to allow the edge of support flange 33*b* to engage in the groove 79*b* provided in the wall 78*b*, thus holding the structure solidly in position. As seen in FIG. 3, a wire connection can be fed in from the side adjacent to and parallel to the spade terminal 32. If provided with a slight curvature, it will engage the tab 41*b* on the backside of the saddle to be directed against the wall 78*b* and back around against the tab 41*b* on the front of the saddle 41. When in place, the nut 39 is tightened on the stud to clamp the conductor 55 between the saddle and the plate 33. It will be appreciated by those skilled in the art that the materials selected at least for the adapter 33 and possibly for the saddle should be made of highly conductive material such as copper, brass or beryllium copper to afford adequate conductivity to the spade terminal 32** and through the circuit protector circuit.

Referring to FIG. 2C, it will be seen that the other type of adapter shown is similar to that shown in FIG. 2A except that the adapter support flange 35*b* and drawn tubular neck 35*c* is provided with threads 35*d* within the opening for engaging screw 43. Otherwise, the slip-on support 35*a* provides a bracketed slide which engages the spade terminal 34 in essentially the same way. The saddle 45 in this case is slipped over the screw 43 and has its tabs 45*b* positioned to engage the side of the support flange 35*b*.

Figure 11:
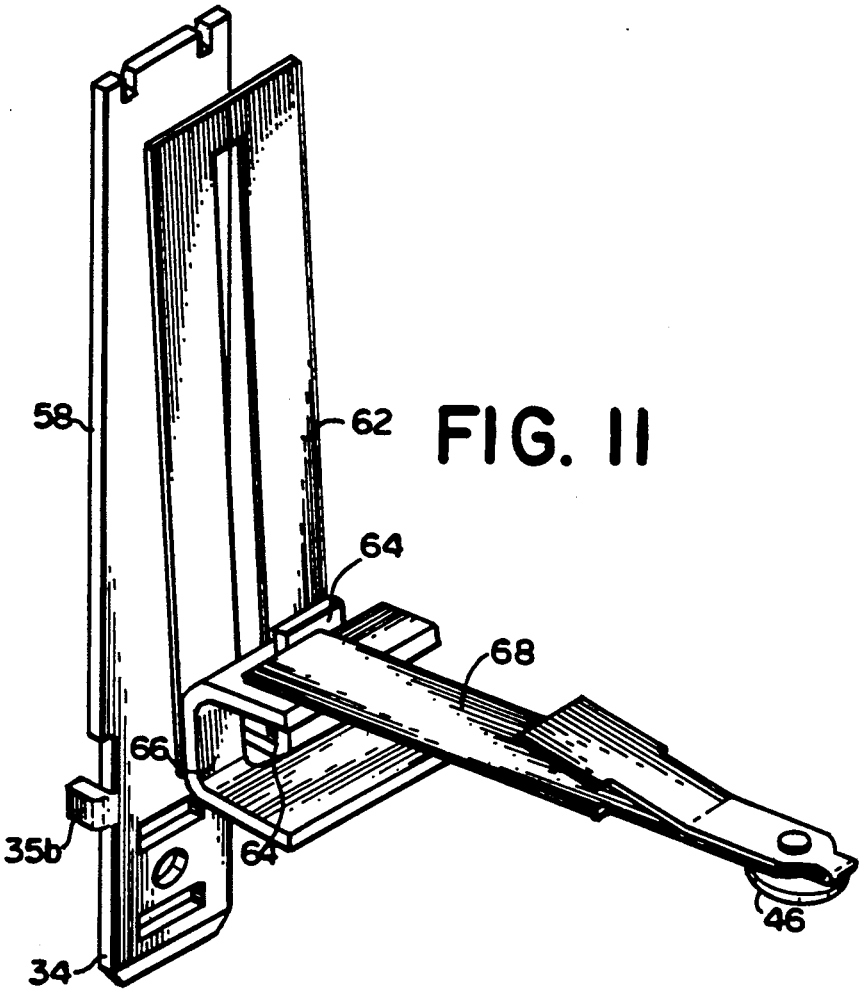
FIG. 11 is a perspective view of the preassembled terminal unit connected through the overload thermoelectric element to the movable contact arm structure.
Figure 12:
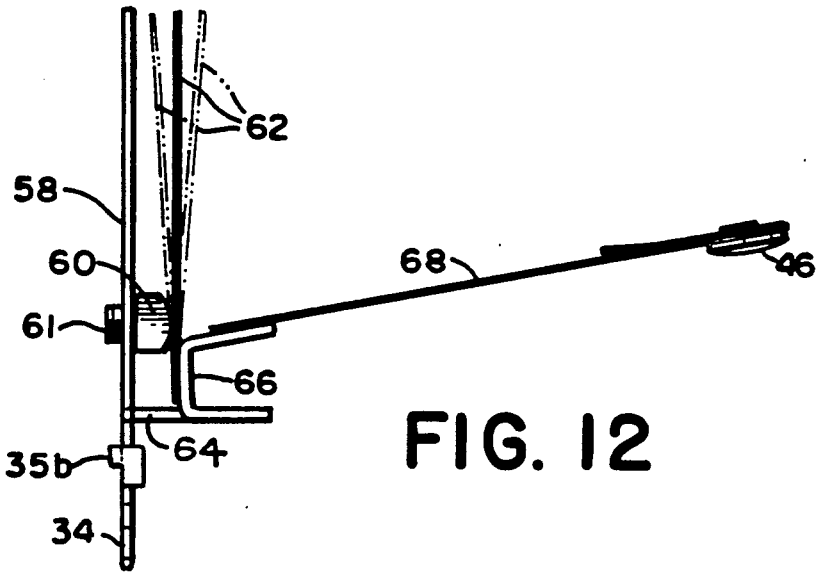
FIG. 12 is a diagrammatic side elevational view of the structure of FIG. 11 illustrating adjustment of the thermoelectric member.

Terminal 34 is connected to the movable contact 46 through the thermal element 62, which is shown in greater detail in FIGS. 11 and 12. A back plate 58 is effectively an extension of terminal 34 after it passes through slot 70 in the base 38. The back plate 58 supports an adjustment member 60, discussed hereafter, which bears against both blades of the U-shaped bi-metallic element 62 to make adjustments. A solid metal conductor element could be substituted for the bimetallic element in an alternative device which is intended to perform only a switch function. The far blade of the bi-metallic element is connected to a portion of back plate 58 which is bent to provide a support 64, best seen in FIG. 11. Support 64 is bent from a piece of back plate 58 first perpendicular to that member and then the end is bent back parallel to member 58. The other end of the bi-metallic element 62 is connected to the outside of the bottom of a U-shaped channel member 66 whose sidewalls slight diverging from parallel to one another are extended laterally after the structure is past member 64. The channel provides not strictly parallel legs in order to give the spring arm 68 on which the movable contact 46 is mounted an inclination diverging away from the base in the direction toward the contact 46. Both members 64 and 66 to which the U-shaped bi-metal member 62 is conductively affixed are electrically conductivity and sufficiently sturdy mechanically to avoid mechanical movement. To maximize mechanical rigidity and assure that mechanical movement is minimized, back member 58 the extension of terminal 34 passes through the base in a closely confining upwardly extending passage 70, again a slot extending inwardly from the edge of the base plate 38. Moreover, member 64 first passes laterally through passage 72, then upward in passage 74. In assembly, after member 64 is inserted into the edge of the slot passages and pressed into the passages, support 66 will pass into the slot passage 74 and the extension of passage 72. Thus because of snug engagement in the base passages support members 64 and 66 are both firmly anchored to the base plate 38 to prevent their movement.

A stop 69 is also supported on each side of the back plane 40 to limit the upward movement of the moveable contact 46 and its support and particularly to eliminate vibrations of the contact which might otherwise occur. Support for such a stop could alternatively be from the medial plane frame 42.

Although a single pole protector can be provided and the actuation means assembled for that single pole, the structure of the present invention with its medial plane frame 42 lends itself particularly advantageously to a double pole construction with the terminals, circuit protector contacts and protector associated elements repeated on both sides of the medial plane frame 42. These electrical and mechanical supporting parts may be identical, but are introduced into slots of the same configuration in mirror image location extending laterally inward toward the medial plane frame from opposite edges of the base plate 38. Provision of these slots permits preassembled structures, which are designed to provide passage which conform to bends of the structures, to be slid into the slots, and tabs are positioned to further aid in holding them securely in place and ready for operation upon insertion. For example, tabs 35*a* and 35*b* are positioned to lie below the base plate 38 and help anchor the structure of each back plate 58 with the cooperation of support conductor 64 and channel 72.

In passing it should be observed that channel 76, between lateral walls 78*a* and 78*b* beneath the base 38 has lateral guide grooves 76*a* and 76*b* in these transverse walls to receive a terminal block. A similar channel 77 is provided by extensions of walls 78*a* and 78*b* on the opposite side of a dividing partition 80 which extends across the base plate. These walls 78*a* and 78*b* and 80 are advantageously of a uniform height. In addition to providing the auxiliary switch and connection terminal channels 77 and 76, they form insulated pockets to protect the terminal 32 and 34 and the respective connectors 54 and 56 attached to these terminals. When not in use for auxiliary switches or terminals the option is available to close off these channels 76 and 77 using flat plates, conveniently of the same material as the base 38. Such plates fit snugly into the support grooves 76*a* and 76*b*, for example, and extend the length of the channels. As previously eluded to in connection with FIG. 1 the ends of the channels are by extension tabs 26.

Above the base plate, mechanical actuation structure is provided to operate circuit protector contacts 44 and 46 in response to movement of their associated bi-metallic actuator.

The mechanical actuator structure of the present invention is particularly novel with its geometry and layout being specifically more open and easier to assemble and trouble shoot than the prior art. The ability to duplicate structure on both sides of the medial plane frame makes possible two circuit protector poles with fewer parts and easier assembly. Moreover, the parts including many of the connecting pins may be made of ULTEM ® or other suitable molded resinous material. The parts lend themselves to being cast to form broad bearing or guide surfaces as well as actuating surfaces and such materials having good wear qualities even in the bearing requirements herein and are sufficiently hard to provide durable accurate latch parts.

The rocker handle 30 is supported to the medial plane frame 42 by a pin 82. The rocker handle consists of a cover 84 which may be transparent or translucent in order to transmit light as will be discussed hereafter. It also functions to clamp together two pieces 86*a* and 86*b* which provide an integral rocker handle and crank arms 88*a* and 88*b*. A spring member 90 extends between the handle 30 and the back plane 40 to urge the switch into off position as shown. Spring 90 has one end snugly fitting around post 40*a* on back plane 40 and the other end around a similar post 92*a* extending from a boss 92 on crank arm 88*a*. Only one spring on one side of the medial plane frame is needed. Crank arm 88*a* is connected to side piece 93*a* of rocker 94 by a link 96 preferably provided in a novel integral structure. Linkage member 96 has parallel pins 96*a* and 96*b* whose center lines are indicated on FIGS. 3 and 4, but which may be better seen on FIG. 9. An identical linkage member 96 is used to connect crank arm 88*b* to rocker piece 95*b*on the other side of the medial plane frame 42. The rocker side pieces 93*a* and 93*b* are provided with cam extensions 97*a* and 97*b*, respectively, each of which bears against and moves a movable contact arm support 68, which preferably is also a resilient spring conductor. Rocker 94 also has a latch projection 98 having a latch surface 98*a* which is engaged by a keeper 100*a* on latch lever 100. Rocker 94 also has a pin 102 extending through guide slot 104 which slot is shaped to control the movement of the pin and hence the rocker. The latch lever 100 has two parallel legs over much of the length and is supported on the medial plane frame projection 110, which the legs snugly embrace, by pin 105 through the legs and projection 110 parallel to pins 82, 96*a*, 96*b* and 102. A latch lever is provided with a spring 106 connected between support post 108*a* on shoulder 108 interconnecting the parallel legs of the latch lever and post 110*a* supported on an edge surface of a projection 110 of the medial plane frame 42. In this connection it will be noted that the projection 110 is formed because the medial plane frame is cut away to give clearance to all anticipated rotational positions of the latch level. Spring 106 is a lighter spring than spring 90, but has sufficient force to urge latch lever counterclockwise about pin 105 as seen in FIG. 3 and into the latch projection 98 of rocker 94. The latch lever may be variously formed. It need not have dual structures to operate with the two poles except for the actuator base. It advantageously has balancing extensions extending in opposite directions from the pin 105 the transverse actuator bar 112 of latch 100 being on the opposite end from the latch keeper 100*a*. Upon the occurrence of sufficient overload, the actuator bar will be contacted by bi-metallic element 62 to move the latch lever against the force of spring 106 and unlatch the latch lever.

Figure 4:
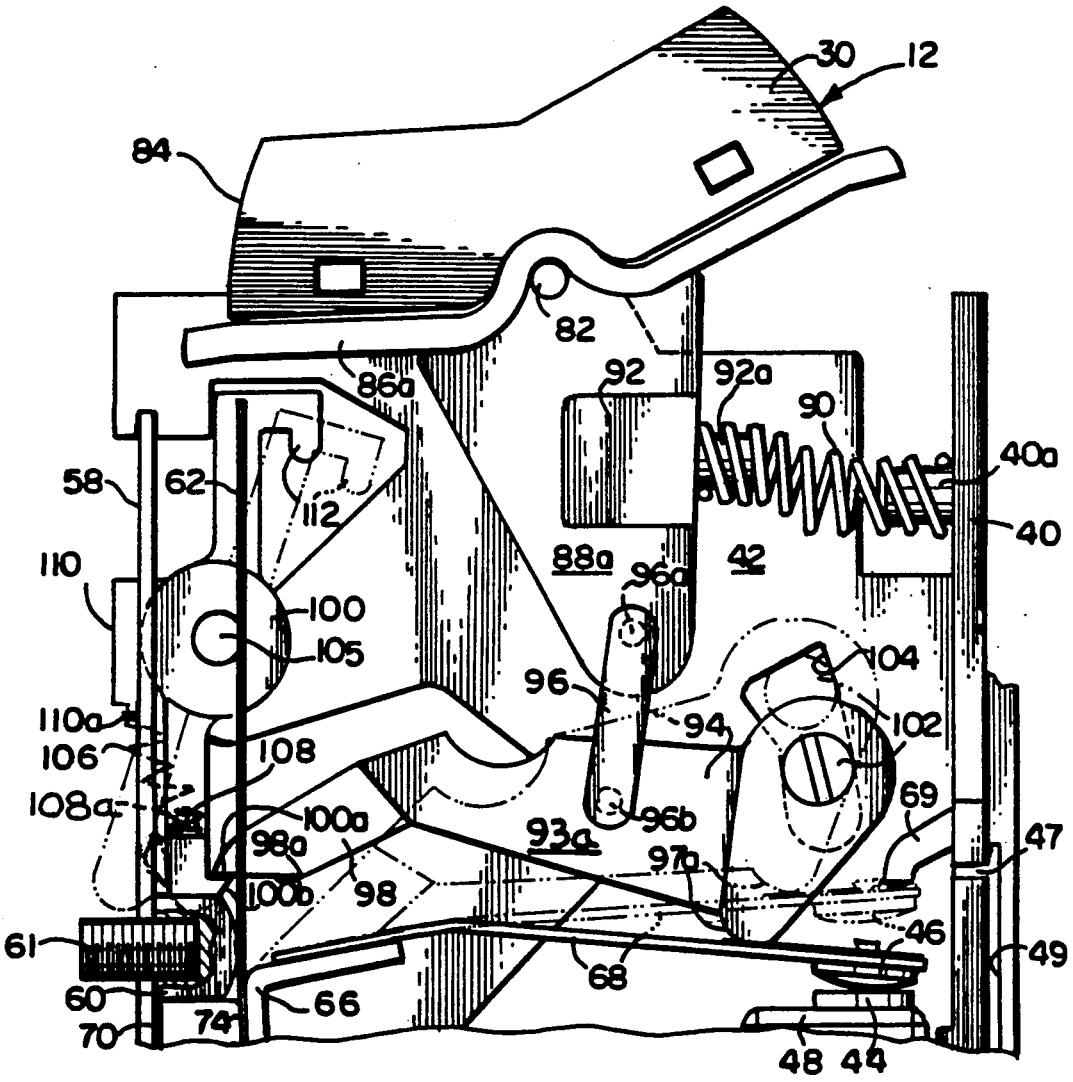
FIG. 4 is a partial elevational view of part of the structure of FIG. 3 showing the switch contacts in closed position and showing in dashed lines the change of positions occurring upon release of the latch lever.

Referring particularly to FIG. 4 in comparison with FIG. 3, it will be seen that the structure shown in solid line depicts the position of the structure when the rocker handle 30 has been pushed to its on position. On position is defined by a stop 91 (FIGS. 5 and 7) which stops crank arm 88*b* and the structure in the position shown in FIG. 4. Such a stop on the medial plane frame 42 is most conveniently provided to stop movement of the handle on the side opposite from spring 90. As movement to the closed contact condition of FIG. 4 occurs, the crank arm 88*a* is moved counterclockwise about pin 82 compressing spring 90 and cam surface 97*a* moves against spring arm 68 to close the movable contact 46 into fixed contact 44. The link is unable to drive the rocker 94 to the right because of the limiting effect of pin 102 in slot 104. The rocker structure moves downwardly with pin 102 moving along the guide slot 104 and the latch surface 98*a* moving down into engagement with latch keeper 100*a* which it is unable to pass. The support arm 68 is preferably made of resilient conductive material and is somewhat deflected in the process improving the electrical contact between circuit protector contacts 44 and 46 and storing energy which may be used to move rocker 94 and quickly open the contacts. The circuit protector will remain in the solid line position of FIG. 4 until an overload occurs. At that time thermal actuator bi-metal 62 will move against actuator bar 12 of the latch lever 100 rotating it clockwise until the latch keeper 100*a* is disengaged from the latch surface 98*a* of the rocker allowing it to move down to the dashed line position. Under urging of the resilient contact arm support 68, the cam 97*a* moves upwardly and the rocker rotates about pin 96*b* to move latch member to the dashed line position of FIG. 4. The resulting movement of link pin 96*b* destabilizes the over center position of link pin 96*a*, which in the solid line showing had passed into a stable over-center position between the link pin 96*b* and the handle pin 82 in latched condition. Once link pin 96*a* passes back over center the spring 90 urges the switch handle back to the position of FIG. 3. In the course of this movement the rocker is moved upward. The upper surface of its latch portion 98 engages the cam surface 100*b* from a position to which it may have returned as the bi-metal has quickly cooled and moves the latch against the action of spring 106 out of the way to allow the latch portion to pass above the latch keeper at which point the latch is restored to the position of FIG. 3. In this condition, the circuit protector is again ready to operate assuming the latch lever has returned to contact the latch member 98 of rocker 94.

The present invention lends itself to fabrication of a circuit protector which is highly precise, at least as accurate as circuit protectors made in other ways, but which, because of its simplified parts, their limited number and their ease of assembly can be put together quickly with a limited amount of effort with the result that manufacturing cost is greatly reduced. The geometry of the device, as described thus far, contributes to accuracy of operation and ease of assembly. Because the device has two poles it permits some of the parts to serve in common for two poles. The symmetrical structure about the medial plane frame 42 further adds to the efficiency and simplicity of the structure and also makes for balance and evenness of wear.

Consider now the base and frame of FIGS. 5, 6 and 7. As seen in FIG. 5 a wiring terminal block 113 is shaped to be slid into channel 76 where it will be retained by cover tab 26. The wiring block is provided with terminals 114*a* and 114*b* connected respectively to small flexible insulated wires 116*a* and 116*b*. The terminals extend through the block for connection below the block. In other instances the block may be provided with a plug-in receptacle. The block itself has laterally extending flanges 113*a* and 113*b* which are snugly engaged within grooves 76*a* and 76*b*. Even before the assembly is slid into slot 76; however, its wires 116*a* and 116*b* are together fed through the small opening 118 through the medial plane frame 42 and out the other side. As seen in FIG. 7 the wire is next fed through a small opening 120 at the end of surface channel 122 in the medial plane frame. Pulling the wire through the hole 120 causes the wire to lie in the channel 122, thus completely out of the way. Next observing FIG. 6, the wire is fed through a hole 124 at the other end of a short, bent or curved groove 126 so that when pulled tight it will lie in the groove 126. Finally observing again FIG. 7, the wire is pulled through an opening 128 in the medial frame which causes it to lie flat in channel 130. Finally, there is a short channel 132 seen in FIG. 6 into which the wires 116*a* and 116*b* are fed to direct them to terminals at one end of the cylindrical bulb supported in a flexible conforming clip 134 at the top of and integrally a part of the medial plane frame 42. The clip holds the generally cylindrical light bulb affixed to the ends of the leads as seen in FIG. 7 in horizontal position generally transverse to the medial plane frame in position to lie immediately below the lens 84 of the rocker handle.

How the lamp is energized depends upon its nature. If it is an incandescent lamp, for example, it may be operated by an auxiliary switch, for example an auxiliary switch 138 which as shown in FIG. 7 may be located in the groove keyway 77 on the side of the mounting base shown in FIG. 7. The plunger 138*a* of the auxiliary switch 138 may be actuated by the flexible or resilient movable contact supporting arm 68 and by an auxiliary switch actuator block 121 attached to that arm for the purpose of actuating the auxiliary switch 138. In such a configuration if the auxiliary switch were connected in series with one of the leads 116*a*, for example, the light would indicate when the contacts were closed. The pair of terminals 114*a* and 114*b* must be connected to a source of power and the auxiliary switch. One looking at a bank of such circuit breakers on a panel board would immediately be able to distinguish which circuits were in operation by illumination of their handle lenses and which were disconnected. Of course, the switch could be arranged so that it operated in the other way, i.e., with normally closed contacts so that the light would be illuminated when the breaker contacts were opened and extinguished when the contacts closed.

Figure 8:
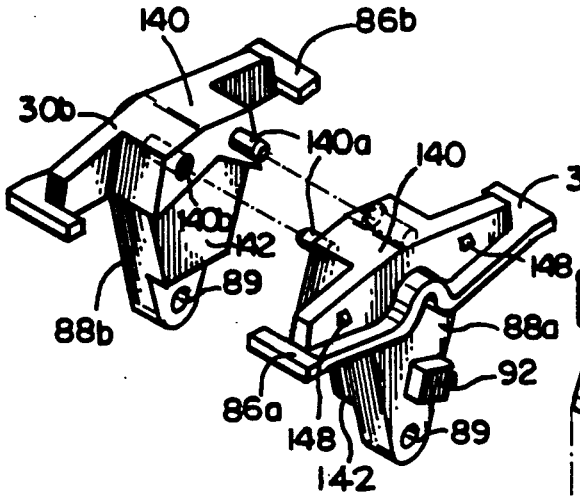
FIG. 8 is a perspective view showing the two pieces comprising the handle separated from one another in position to be joined together.
Figure 9:
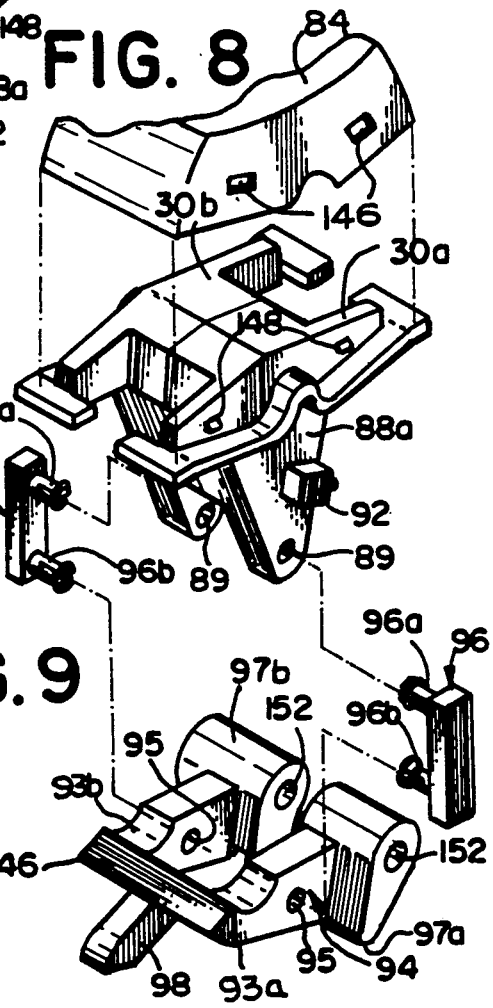
FIG. 9 is a view of the pieces shown in FIG. 8 joined together and showing how the cap and the rocker with intermediate links are put in place.

Once the light is assembled to the base and frame of the circuit protector the rest of the assembly may be completed. The pieces involve an assembly and the steps may be visualized by reference to FIGS. 8, 9 and 10. FIG. 8 shows pieces of the rocker handle assembly 30*a* and 30*b* before they are assembled together. Members 30*a* and 30*b* are identical pieces. Each switch rocker part 86*a* and 86*b* is molded integrally with an actuator arm or crank 88*a* or 88*b*. Each also has a spring mounting block 92. But only one is used, the one on actuator arm or crank 88*a* seen in FIGS. 3 and 4. Each handle piece is provided with a bridge portion 140 having a pin 140*a* and a receiving socket for the pin 140*b* positioned so that as the pieces 30*a* and 30*b* are turned to face each other, the respective pins will fit into the respective sockets with two flat bearing surfaces brought firmly together as seen in FIG. 9. Additionally the top 142 of the crank arm 88*a* or 88*b*, is somewhat thicker than the rest of the arm but enough dimension set back to fit snugly over the medial plane frame 42 when the pieces are assembled together. Since the parallel surfaces of portions 142 are spaced to be just wide enough to snugly accommodate the medial frame, they also serve as guide or bearing members to keep the handle arm properly aligned when placed over the medial plane frame, at which time the pin 82 is inserted. Thereafter they aid in preventing twisting or misalignment.

As a practical matter, before this is done the assembly shown in FIG. 9 is completed. The lens cap 84 is provided with small holes 146 on each side of the lens cap to mate with a pair of detents 148 on each side of the switch handle. The lens cap 84 when snapped in place advantageously conforms to mating portions of the handle. However, the handle 80 has sufficient cut-away portions to allow light from a lamp 136 in socket 184 to be seen.

A pair of linkage members 96 having integral pins 96*a* and 96*b* are provided, one on each side of the medial plane frame 42, may be cast of resinous material such as ULTEM ®, for example. The split end allows each pin to be deformed into the slot, until they pass through a closely confining bearing hole, and then snap back upon the passing out from the hole of the circumferential ridge at the end of the pin. Pin 96*a* fits in each crank arm at pin hole 89 and pin 96*b* fits into pin hole 95 in side pieces 93*a* and 93*b* of rocker 94. In this particular version of the rocker there is a structure with two parallel side pieces 93*a* and 93*b* joined by a cross bar 146 to support the latch member 98. The medial plane frame is cut away to accommodate the cross bar and latch in all possible positions of the rocker. Identical cam members 97*a* and 97*b* are provided on the respective rocker side pieces 93*a* and 93*b*. The inside surfaces of the members are flat and parallel and spaced to closely confine the medial plane to help prevent twisting and misalignment of the rocker. The plastic pins 96*a* and 96*b* are insertable, respectively, into the holes 89 and 95 of the circuit protector handle 30 and the rocker 94.

When the assembly is completed it may be placed over the medial plane frame in proper position for the metal pin 82 to be inserted through aligned holes in the handle and the medial plane frame 42. Next pin 102 is inserted in the aligned holes in cam member 97*a* and 97*b* and the guide hole 104 in the medial plane frame 42. This pin 102 is preferably made of the same kind of resinous material, ULTEM ®, having an enlarged end with a shoulder at one end and an axial diametrical slot and a circumferential ridge around the other. Pin 102 is similar in form to pins 96*a* and 96*b* at the insertable end and has a head with a shoulder limiting axial movement at the other end. Preferably at the time the structure is put in place the movable circuit protector contact arm and the fixed line terminal contact and the bi-metal actuator structure are all in place.

Figure 10:
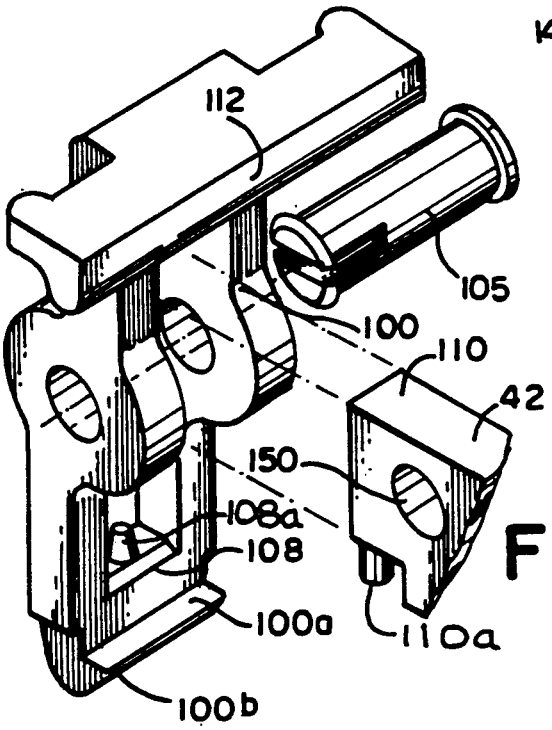
FIG. 10 is a perspective view showing the latch and its attachment pin for assembly to the main frame.

Similar to the assembly of the other mechanical members to the medial plane frame, the latch lever 100 is assembled to the medial frame using pin 104 of similar form to pin 102 which passes through hole 150 in extension 110 as well as the parallel arms of latch lever each side of the hole. As seen in FIG. 10, the parallel sides of the legs of lever 100 closely confine extension 110 and help prevent the lever 100 from twisting. The spring 106 can then be assembled between pin 110*a* and 108 to give the latch lever its required bias toward the rocker latch member 98. The spring 90, which is heavier, may be assembled between pin 40*a* on the back plane 40 and pin 92*a* on the boss 92 on the actuator link 88*a*. Thus assembled the required biasing forces are present which together with the spring force of arm 68 causes the system to operate as previously described.

The assembly of the respective terminal members and the supported contacts as well as the intermediate actuator described has been previously described. Of particular significance is the provision of a pair of terminal assemblies which can be readily and quickly installed so that the total assembly time for putting together the whole circuit protector unit by a skilled assembler, except for the optional wiring of the electric bulb, is under a minute and may be even reduced from that level. Even the wiring is very easy and quickly accomplished. Another particularly valuable aspect of the present invention is the ability to calibrate the assembly shown in FIG. 11 before it is put into the circuit protector base and support frame. In fact, it may be calibrated as it is manufactured and stored as inventory ready to install. Precalibration allows circuit protectors to be rapidly assembled and shipped with minimal testing. FIGS. 3 and 4 show an adjustment structure which enables the position of the bi-metal to be changed as shown in FIG. 12. The adjusting member 60 is moved by a screw 61 threaded through the terminal 34 extension 58. Rigidity is provided for this adjustment by a frame construction which extends the base higher than its general top plane level in a region 152 and backs the back plate extension 58 with a partial back plane 154 which is suitably cut-away to give access to the adjusting screw 61. In this connection, the housing 16 is provided with screw adjustment openings 156 through which adjustment can even be made after the assembly is in place. Thus despite precalibration and the intention to avoid adjustment after assembly, adjustment is always possible as needed and easily accomplished or changed at the site of use. FIG. 12 shows a range of adjustment which allows proper positioning of the top of the bi-metal member for proper actuation of the actuator bar 112 of the latch lever. It should be remembered that current produced thermal overload at either actuator of the two pole circuit protector may trigger the protector. The system is designed to provide the needed minimum force to move the latch lever against the bias of its spring 106 and to overcome any frictional forces imposed by the rocker latch member 98.

An optional feature of the present invention, but one which may be important in some applications is the provision of an arc suppressing grid plate to surround the end of the movable contact. The grid is preferably supported slightly above the bottom position of the support as shown in FIG. 13. As seen in FIG. 13, the grid 123 has a horseshoe shaped opening, which with relatively close clearances surrounds the end of movable contact support 68 as it moves away from close contact position. The grid plate has an edge 123*a* which fits into groove 119 in the medial plane frame 42 which may be better seen in FIGS. 6 and 7. The groove 119 is bounded by protruding ridges 119*a* and 119*b* which further help to support the edge of the grid 123. Further support is lent to the grid plate by insertion of its tab 123*b* into slot 117. By dimensioning the slots in the grid plate to provide snug fits, the grid plate may be securely held in position and requires a minimum effort in assembly, which, however, must be coordinated with the rest of the assembly.

The circuit protector as described and illustrated herein represents a preferred form of the present invention. However, it will be obvious to those skilled in the art that many variations on this preferred form are possible and various features used in the construction can be used elsewhere for other purposes. The application is intended to be representative of the invention and not limiting thereto. Other variations within the scope of the appended claims will occur to those skilled in the art and are intended to be within the scope and spirit of the invention.

I claim:

1. A unitary frame of molded resinous material for a circuit protector comprising:

a base adapted to provide support for at least a pair of terminals, a fixed contact and a movable contact support supporting a movable contact cooperating with the fixed contact;

a relatively thin generally planar support frame transverse to and integral with the base for support of contact actuating structure;

a back plane molded integrally with the support frame and the base at one end of the base; and supporting grooves in the support plane and the back plane positioned and adapted to engage and support a grid element arranged proximate to the edges and end of the movable contact support as it moves away from the fixed contact.

2. The unitary frame of claim 1 in which each supporting groove in the planar support frame is effectively extended by ridges extending outward from the groove on each side of the groove.

3. The unitary frame of claim 1 in which the generally planar support frame effectively divides the base in half and provides equivalent space for a complete circuit protector each side of the generally planar medial support frame wherein grid engaging and supporting grooves are provided on each side of the support plane and in the back plane on both sides of the support plane.

4. The unitary frame of claim 3 in which each supporting groove in the planar support frame is effectively extended by ridges extending outward from the groove on each side of the medial support plane.

* * * * *

UNITED STATES PATENT AND TRADEMARK OFFICE

CERTIFICATE OF CORRECTION

PATENT NO. : 5,064,977

DATED : November 12, 1991

INVENTOR(S) : Joseph Fierro

It is certified that error appears in the above-identified patent and that said Letters Patent is hereby corrected as shown below:

Column 5, line 9, after "sidewall" insert --24--.

Column 9, line 64, delete "12" and insert --112--.

Signed and Sealed this

Twentieth Day of April, 1993

*Attest:*

MICHAEL K. KIRK

*Attesting Officer*

*Acting Commissioner of Patents and Trademarks*